US005673811A

United States Patent [19]

Dickinson et al.

[11] Patent Number: 5,673,811

[45] Date of Patent: Oct. 7, 1997

[54] FOOD BIN ASSEMBLY

[75] Inventors: Thomas Dickinson; Bradley D. Gale, both of St. Louis; Martin Shawn Egan, Ballwin, all of Mo.

[73] Assignee: Contico International, Inc., St. Louis, Mo.

[21] Appl. No.: 610,748

[22] Filed: Mar. 4, 1996

[51] Int. Cl.[6] ..... B65D 51/04

[52] U.S. Cl. ..... 220/331; 220/335; 220/337; 220/346; 220/351; 220/659

[58] Field of Search ..... 220/331, 335, 220/337, 345, 346, 351, 657, 659

[56] References Cited

U.S. PATENT DOCUMENTS

| | | | |
|---|---|---|---|
| D. 217,498 | 5/1970 | Dilyard . | |
| D. 281,111 | 10/1985 | McClelland . | |
| D. 309,209 | 7/1990 | Oliemans et al. . | |
| D. 324,440 | 3/1992 | Daugherty . | |
| D. 326,754 | 6/1992 | Hradisky . | |
| D. 327,560 | 6/1992 | Hradisky . | |
| D. 327,561 | 6/1992 | Hradisky . | |
| D. 330,328 | 10/1992 | DiSesa, Jr. . | |
| D. 336,243 | 6/1993 | Evans . | |
| 2,661,119 | 12/1953 | Spiess, Jr. et al. | 220/331 |
| 3,295,907 | 1/1967 | Galvin . | |
| 3,512,696 | 5/1970 | Ebert . | |
| 3,860,309 | 1/1975 | Brendgord . | |
| 4,230,381 | 10/1980 | Rhoades . | |
| 4,260,069 | 4/1981 | Juergens . | |
| 4,567,985 | 2/1986 | Beljaars . | |
| 4,744,487 | 5/1988 | Welborn . | |
| 4,776,478 | 10/1988 | Miller et al. . | |
| 4,785,964 | 11/1988 | Miller et al. . | |
| 5,022,548 | 6/1991 | Stakis . | |
| 5,092,484 | 3/1992 | Daugherty et al. . | |
| 5,107,990 | 4/1992 | Wicherski et al. | 220/346 X |
| 5,129,535 | 7/1992 | Hradisky . | |
| 5,152,420 | 10/1992 | Bird et al. . | |
| 5,462,189 | 10/1995 | Pierce | 220/254 |

FOREIGN PATENT DOCUMENTS

| | | |
|---|---|---|
| 1188323 | 9/1959 | France . |
| 1401306 | 4/1965 | France . |
| 341458 | 11/1959 | Switzerland . |
| 1219456 | 1/1971 | United Kingdom . |
| 2118529 | 4/1992 | United Kingdom . |

*Primary Examiner*—Stephen Cronin
*Attorney, Agent, or Firm*—Howell & Haferkamp, L.C.

[57] ABSTRACT

A food bin assembly comprising a bin, a rear lid member, and a front lid member. The bin has a bottom and a plurality of walls extending up from the bottom. The walls have upper ends defining a bin opening. One of the walls is a first side wall and another of the walls is a second side wall opposite the first side wall. The rear lid member is configured for covering a rear portion of the bin opening. The front lid member is configured for covering a forward portion of the bin opening. The front lid member is slidably connected to the first and second side walls of the bin for longitudinal sliding movement of the front lid member relative to the bin between a forward position in which the front lid member is positioned over the forward portion of the bin opening and a rearward position in which the front lid member is positioned over the rear portion of the bin opening. The front lid member is also pivotally connected to the first and second side walls of the bin for pivotal movement of the front lid member between a lowered position in which it covers the forward portion of the bin opening and a raised position in which it extends upwardly from the side walls to provide access to the forward portion of the bin opening.

21 Claims, 6 Drawing Sheets

20
22
24
26
28
34
42
60
70
7
7

42
46
30
56
40
50
76
26
84
90
24
86
36
8
8
22
80
60
66
46
62
32

78
54
32
44
42
46
34
22

78
70
54
68
32
72
82
42
46
64
34

78
72
60
70
44
42
46
36
24
26
56

82
60
68
42
78
36
22
24
26
56
64

22
24
26
34
36
40
42
54
56
60
70
72
78
80
84
86
90

FOOD BIN ASSEMBLY

BACKGROUND OF THE INVENTION

This invention relates generally to food bins, and more particularly to food bins of the type having moveable lids.

Food bins are typically used in commercial, institutional and industrial kitchens and bakeries for storing and handling a wide variety of ingredients such as flour, sugar, fruits, vegetables, etc. Conventional food bins usually have horizontal two-part lids with one part slidably coupled or hinged to the other part. Access to the contents of food bins with such horizontal lids is difficult when the bin is located under a table. Also, the lids of such bins tend to jam when telescoped one inside the other.

At least one bin has a forward slidable-pivotable lid member which is slanted relative to a rearward stationary lid member. The forward (moveable) lid member is slidably and pivotally connected to the rearward stationary lid member. A difficulty associated with this bin is that the moveable lid member must be pivoted to a horizontal position before it can be slid rearwardly relative to the stationary lid member. If the moveable lid member is not properly aligned with the stationary lid member it may jam. Also, because the moveable lid member is mounted to the stationary lid member, the stationary lid member must be present for the moveable lid member to operate.

SUMMARY OF THE INVENTION

Among the several objects of the present invention may be noted the provision of an improved food bin assembly; the provision of such a food bin assembly having a moveable lid member and a stationary lid member; the provision of such a food bin assembly in which the moveable lid member is capable of pivoting and sliding independent of the stationary lid member; the provision of such a food bin assembly which is configured for providing easy and convenient access to the contents thereof; the provision of such a food bin assembly in which the moveable member does not need to be pivoted to a horizontal position before it may be rearwardly slid; the provision of such a food bin configured for rapid attachment and removal of the lid members from the bin thereof to facilitate easy cleaning of the bin assembly; and the provision of such a food bin which is of a relatively simple construction.

In general, a food bin assembly of the present invention comprises a bin, a rear lid member, and a front lid member. The bin has a bottom and a plurality of walls extending up from the bottom. The walls have upper ends defining a bin opening. One of the walls is a first side wall and another of the walls is a second side wall opposite the first side wall. The rear lid member is configured for covering a rear portion of the bin opening. The front lid member is configured for covering a forward portion of the bin opening. The front lid member is slidably connected to the first and second side walls of the bin for longitudinal sliding movement of the front lid member relative to the bin between a forward position in which the front lid member is positioned over the forward portion of the bin opening and a rearward position in which the front lid member is positioned over the rear portion of the bin opening. The front lid member is also pivotally connected to the first and second side walls of the bin for pivotal movement of the front lid member between a lowered position in which it covers the forward portion of the bin opening and a raised position in which it extends upwardly from the side walls to provide access to the forward portion of the bin opening.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
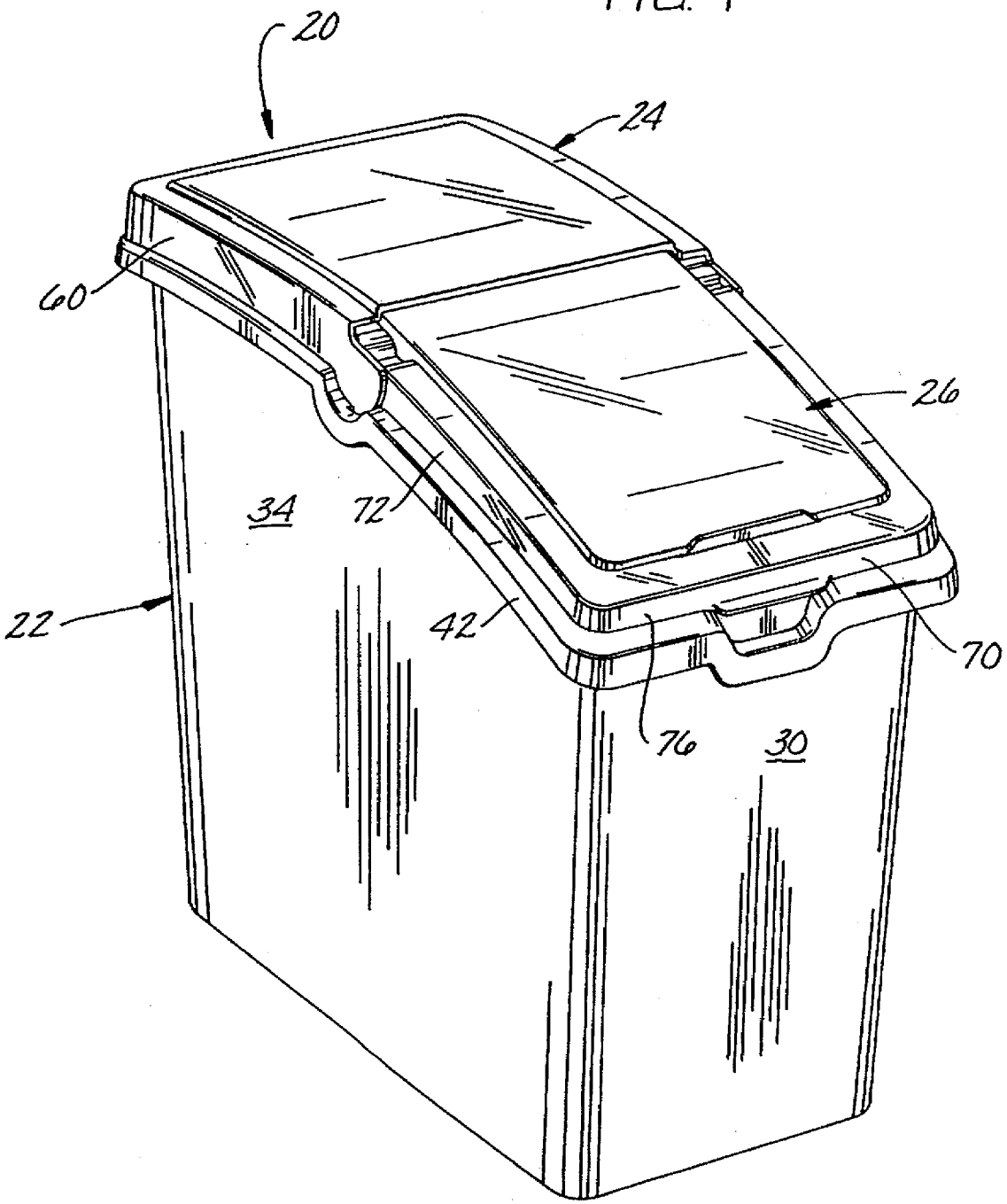
FIG. 1 is a perspective view of a food bin assembly of the present invention having a bin, a rear lid member and a forward lid member.

Referring now to the drawings and more particularly to FIGS. 1–4, a food bin assembly of the present invention is indicated in its entirety by the reference numeral 20. The food bin assembly 20 comprises a bin, generally indicated at 22, a rear lid member, generally indicated at 24, and front lid member, generally indicated at 26. Preferably, the bin 22 and lid members 24, 26 are each single unitary pieces which are injection molded from suitable polymeric materials. Also preferably, the lid members 24, 26 are transparent.

Figures 5, 9, 10:
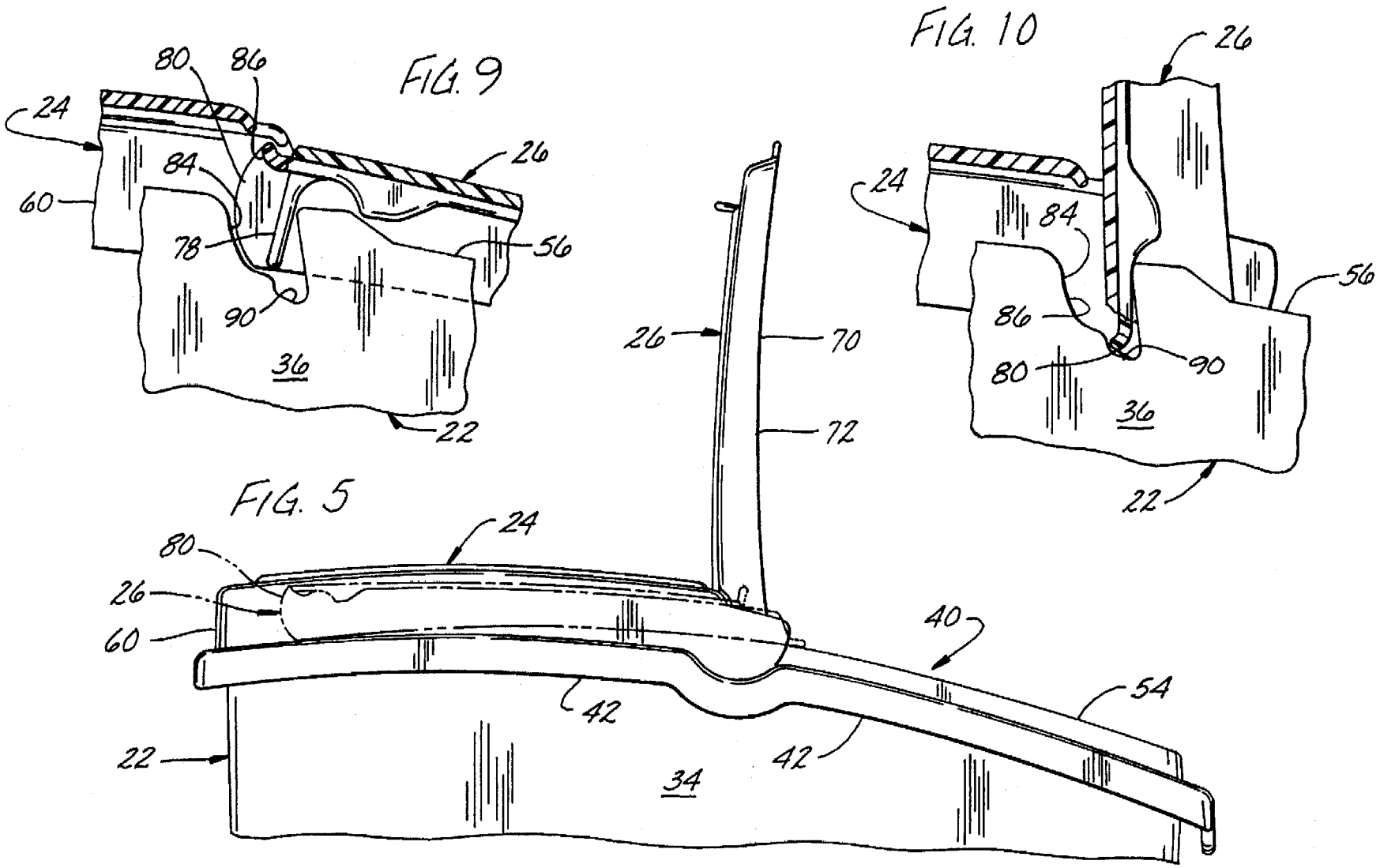
FIG. 5 is a fragmented side elevational view of the food bin assembly of FIG. 1 showing the front lid member in solid lines pivoted to a raised position, and showing the front lid member in phantom lines slid to a rearward position.
FIG. 9 is an enlarged fragmented cross-sectional view taken along the plane of line 9—9 of FIG. 3 showing an inside view of the pivot connection of the front lid member and bin.
FIG. 10 is an enlarged fragmented side elevational view similar to FIG. 9 except showing the front lid member in its raised position.
Figure 11:
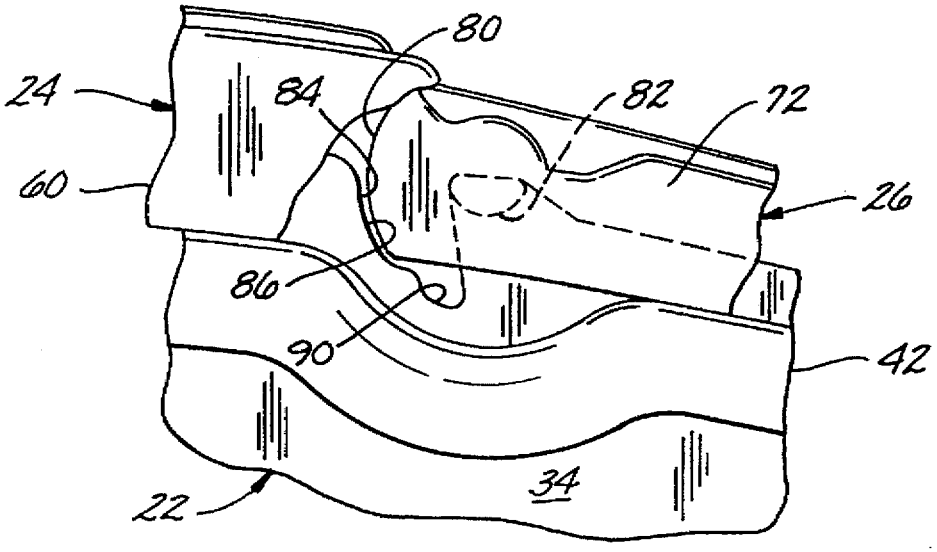
FIG. 11 is an enlarged fragmented side elevational view of the food bin assembly of FIGS. 1–10 with portions broken away to show details of the pivot connection of the front lid member to the bin.
Figure 12:
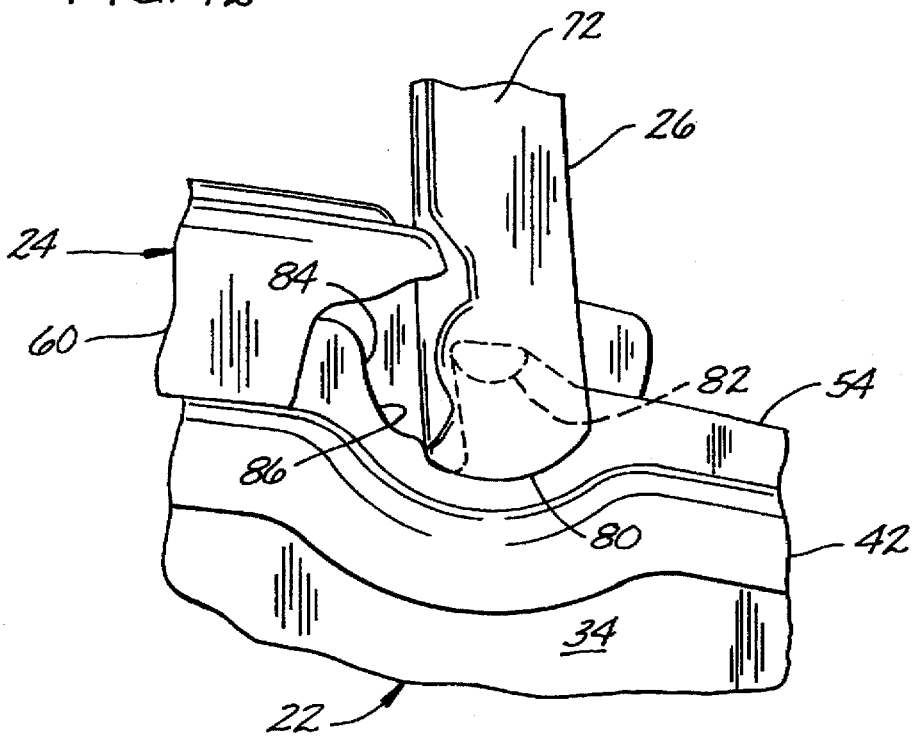
FIG. 12 is an enlarged fragmented side elevational view similar to FIG. 11 except showing the front lid member in its raised position.

The bin has a bottom 28 (FIG. 2) and four walls, i.e., a front wall 30, a rear wall 32, a first (left) side wall 34, and a second (right) side wall 36, extending up from the bottom. The right side wall 36 is opposite the left side wall 34, and the rear wall 32 is opposite the front wall 30. The upper ends of the walls define a bin opening, generally indicated at 40, (FIG. 5) providing access to the interior of the bin 22. As discussed in greater detail below, the rear lid member 24 is configured for covering a rear portion (e.g., rear half) of the bin opening 40, and the front lid member 26 is configured for covering a forward portion (e.g., forward half) of the bin opening.

The front lid member 26 is slidably connected to the left and right side walls 34, 36 of the bin 22 for longitudinal sliding movement of the front lid member 26 relative to the bin between forward and rearward positions. In its forward position (shown in FIGS. 1–4), the front lid member 26 is positioned over the forward portion of the bin opening 40. In its rearward position (shown in phantom in FIG. 5), the front lid member 26 is positioned over the rear portion of the bin opening 40. The front lid member 26 is also pivotally connected to the side walls 34, 36 of the bin 22 for pivotal movement of the front lid member between lowered and raised positions. In its lowered position (shown in FIGS. 1–4), the front lid member 26 covers the forward portion of the bin opening 40. In its raised position (shown in solid in FIG. 5), the front lid member 26 extends upwardly from the side walls 34, 36 to provide access to the forward portion of the bin opening 40.

The bin 22 further includes a circumferential flange 42 extending around the perimeter thereof. The flange 42 is preferably parallel to and spaced a short distance (e.g., ¾") below the upper edges of the walls 30, 32, 34, 36 of the bin 22. Also preferably, the flange 42 is generally L-shaped in transverse cross-section and includes a generally horizontal leg 44 extending outward (i.e., away) from the outer surfaces of the walls 30, 32, 34, 36, and a generally vertical leg 46 depending from the horizontal leg. The portions of the walls 30, 32, 34, 36 extending above the horizontal leg 44 of the flange constitute upper edge margins of the walls. The upper edge margins of the front and rear walls 30, 32 are indicated at 50 and 52, respectively. The upper edge margins of the left and right side walls 34, 36 are indicated at 54 and 56, respectively, and are generally parallel to one another.

Figure 4:
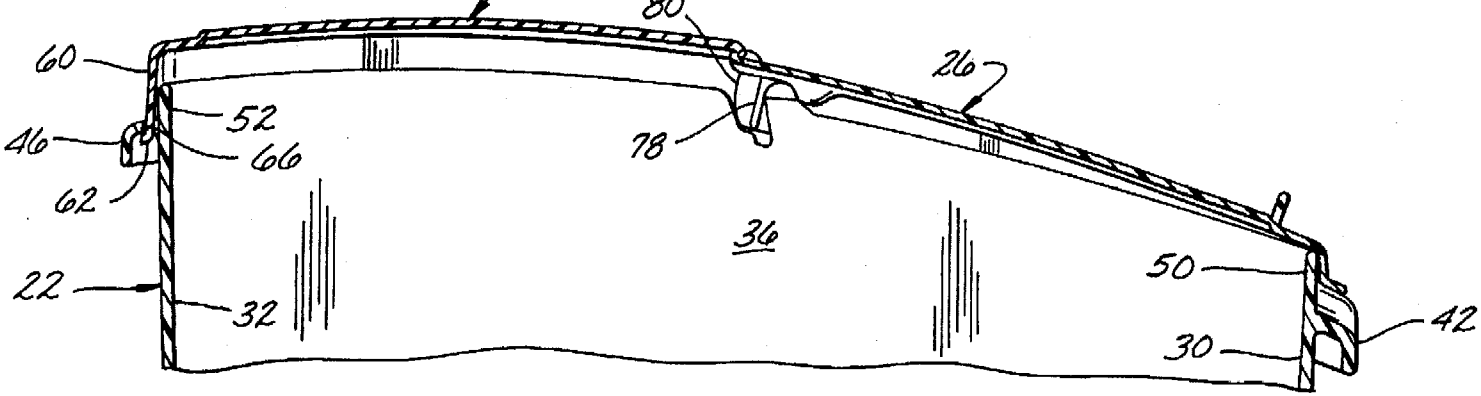
FIG. 4 is a fragmented cross-sectional view taken along the plane of line 4—4 of FIG. 3.
Figure 8:
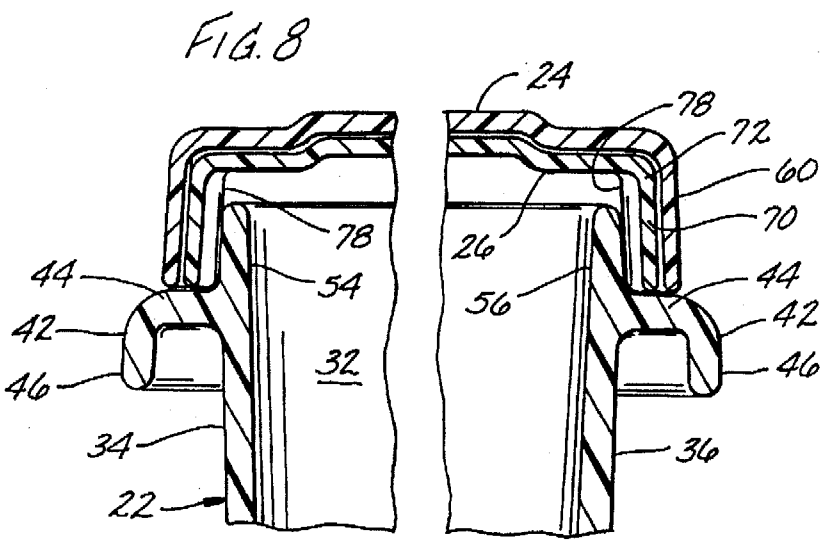
FIG. 8 is an enlarged fragmented cross-sectional view taken along the plane of line 8—8 of FIG. 6.
Figure 7:
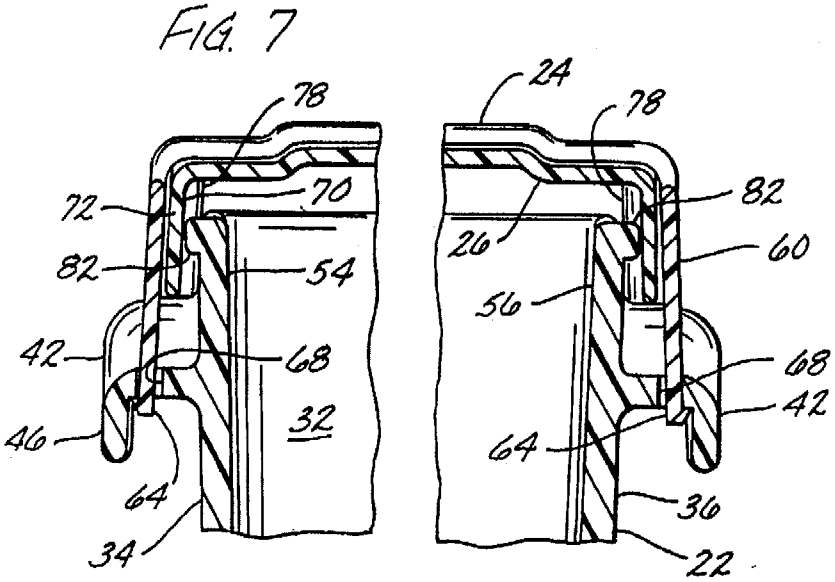
FIG. 7 is an enlarged fragmented cross-sectional view taken along the plane of line 7—7 of FIG. 2.

The rear lid member 24 has a downwardly extending rim 60 along its sides and back. The lower edge of the rim 60 engages and is supported by the circumferential flange 42 of the bin 22 when the rear lid member 24 is positioned on the bin. The rear lid member 24 further includes a rear connecting tab 62 at a back portion of the rim 60 and two side connecting tabs 64 at side portions of the rim. As shown in FIG. 4, the rear connecting tab 62 extends into a rear slot 66 of the circumferential flange 42 and engages the flange to hold the rear lid member 24 against the flange. As shown in FIG. 7, the side connecting tabs 64 extend into side slots 68 in the circumferential flange 45 and engage the flange to further hold the rear lid member 24 against the flange. Preferably, the rear and side tabs 62, 64 have outwardly protruding lips engageable with an underside of the circumferential flange 42 to releasably lock the rear lid member 24 against the bin 22. The rear lid member 24 is shaped and configured so that the side portions of the rear-lid rim 60 are spaced laterally outwardly from the upper edge margins 54, 56 of the left and right side walls 34, 36 (FIGS. 7 and 8) when the rear lid member is connected to the circumferential flange 42. Also preferably, the rear-lid rim 60 is taller than the upper edge margins 52, 54, 56 of the rear and side walls 32, 34, 36 (FIGS. 7 and 8) to space the top of rear lid member 42 above the upper edges of bin side walls. Because the rear lid member 24 is spaced laterally from and above the upper edge margins 54, 56, the front lid member 26 slides under the rear lid member when the front lid member is moved between its front and rear positions.

Figure 2:
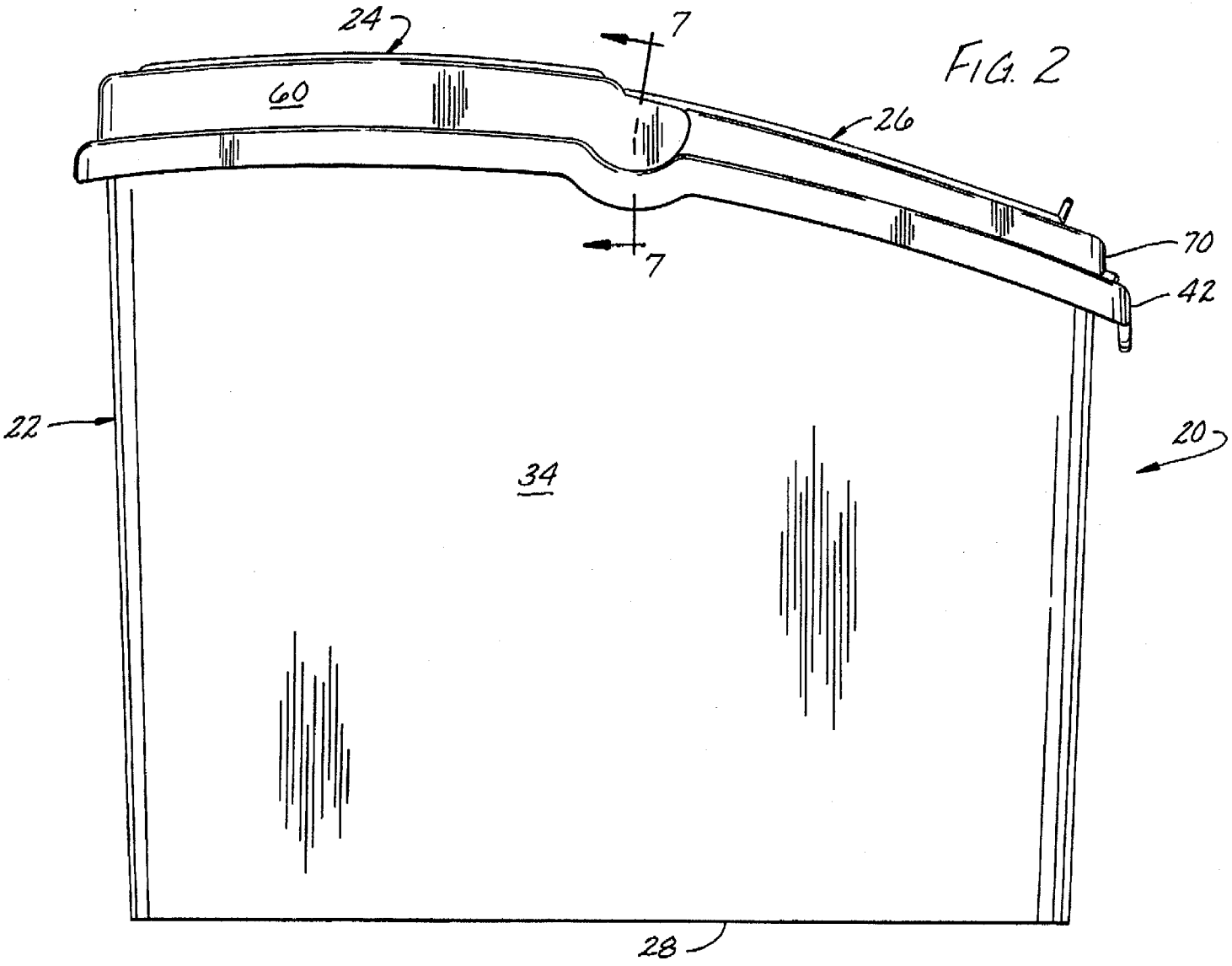
FIG. 2 is a side elevational view of the food bin assembly of FIG. 1.
Figure 3:
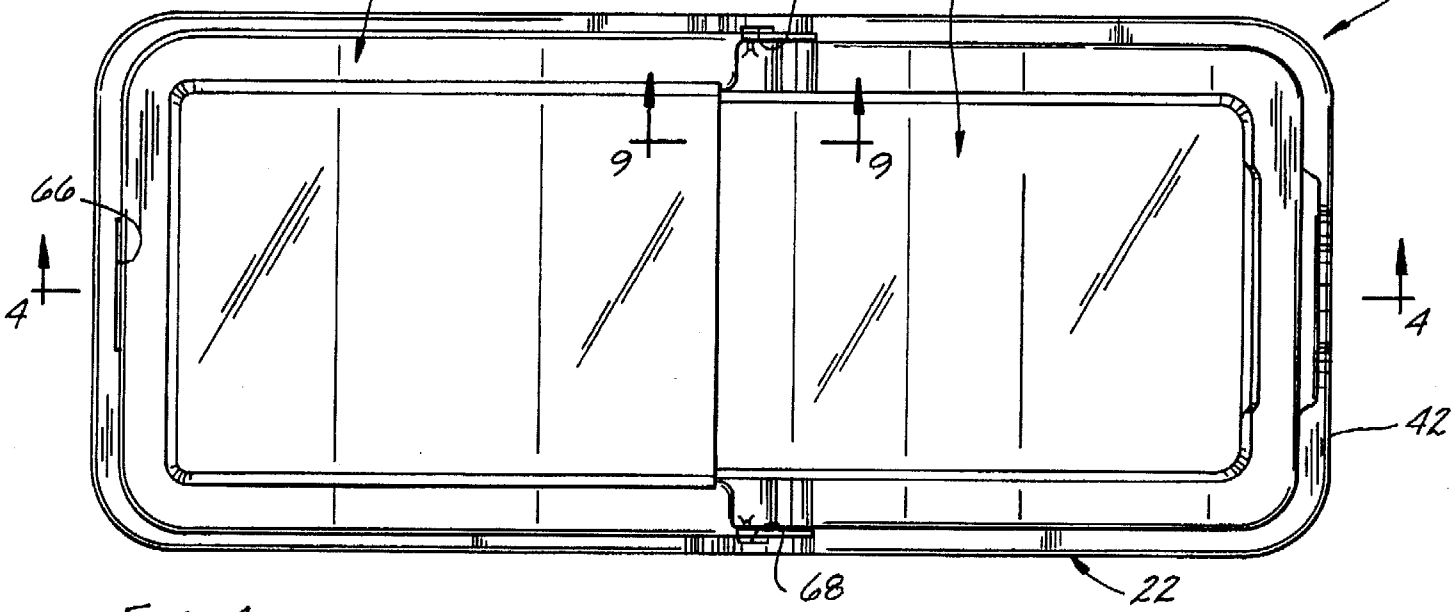
FIG. 3 is a top plan view of the food bin assembly of FIG. 1 showing the front and rear lid members covering the top of the bin.
Figure 6:
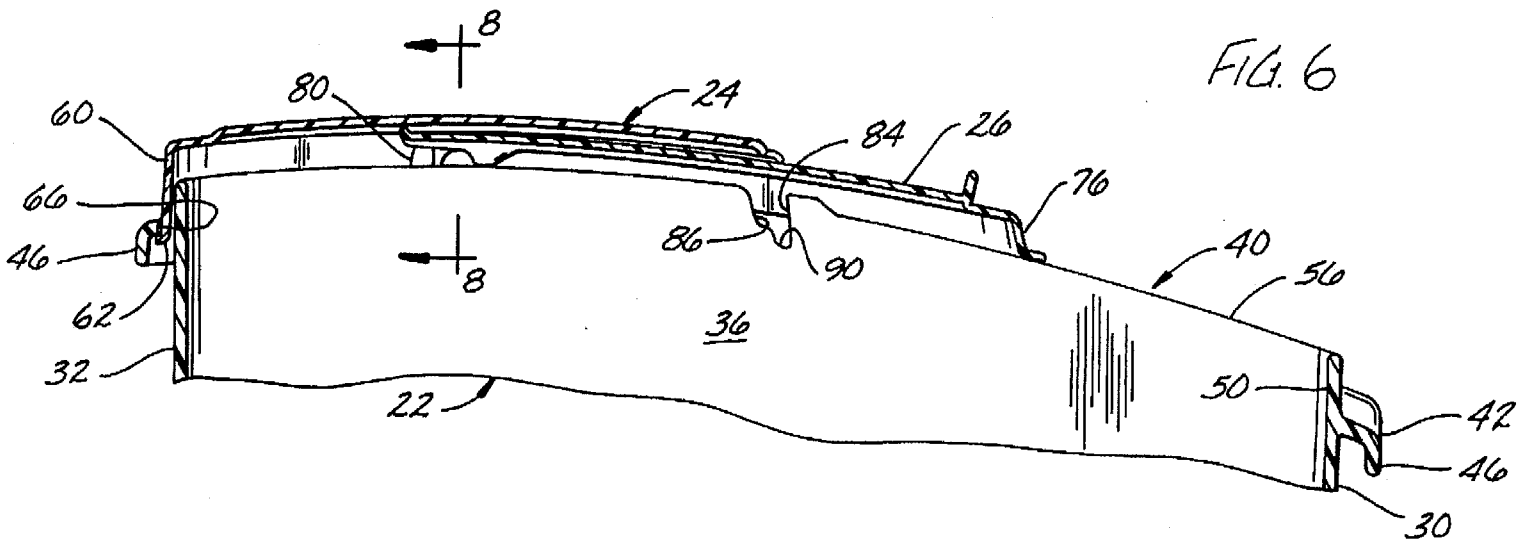
FIG. 6 is a fragmented cross-sectional view similar to FIG. 3 except showing the front lid member slid to an intermediate position between forward and rearward positions.

The front lid member 26 has a downwardly extending rim 70 along its sides and front. As shown in FIGS. 1 and 2, the lower edge of the rim 70 engages and is supported by the circumferential flange 42 of the bin 22 when the front lid member 26 is its forward (or lowered) position. Preferably, the front-lid rim 70 has rim side portions 72 and a rim front portion 76. The rim side portions 72 are positioned adjacent to and laterally outward of the upper edge margins 54, 56 of the side walls 34, 36 of the bin 22. Preferably, the rim front portion 76 is positioned adjacent to and forward of the upper edge margin 50 of the front wall 30 when the front lid member is in its forward (lowered position). Two opposing guide tabs 78 (FIGS. 7–9) project laterally inwardly from rear ends 80 of the rim side portions 72. The guide tabs 78 are configured for sliding engagement (i.e., sliding contact) with the upper edge margins 54, 56 of the side walls 34, 36 of the bin 22 as the front lid member 26 is moved between its forward and rearward positions. The guide tabs 78 and the upper edge margins 54, 56 limit lateral movement of the front lid member 26 relative to the bin 22. Moreover, when the front lid member 26 is in its forward position, the guide tabs 78 abut ears 82 extending laterally outwardly from the upper edge margins 54, 56 of the bin side walls. The ears 82 act as stops to prevent forward movement of the front lid member 26 beyond its forward position. Preferably, the rim front portion 76 of the front lid member 26 is configured for slidably engaging the upper edge margins 54, 56 of the bin side walls 34, 36 as the front lid member is moved between its forward and rearward positions. More particularly, and as shown in FIG. 6, the rim front portion 76 is configured for slidably engaging the upper edges of the edge margins 54, 56 as the front lid member 26 is moved between its forward and rearward positions.

Referring now to FIGS. 9–12, the bin 22 and front lid member 26 are configured for pivoting movement of the front lid member relative to the bin. The upper edge margins 54, 56 of the bin side walls further include cut-outs (i.e., recesses) 84 adjacent to and rearward of the outwardly extending ears 82. The cut-outs 84 define curved Guiding surfaces 86 engageable with a rearwardly facing edge 88 (FIGS. 9 and 10) of the front lid member 26. The curved guiding surfaces 86 of the bin 22 and the rearwardly facing edge 88 of the front lid member 26 cooperate to facilitate pivotal movement of the front lid member relative to the bin between its raised and lowered positions. The guide tabs 78 of the front lid member 26 engage the ears 82 of the bin 22 when the front lid member is in its raised position to hold (lock) the front lid member in its raised position. The cut-outs 84 further define locking notches 90 into which the rearwardly facing edge 88 of the front lid member 26 sits when the front lid member is in its raised position to further lock the lid member in its raised position.

Referring again to FIGS. 4 and 6, the upper edges of the bin side walls 34, 36 preferably have an arcuate shape, and the lid members 24, 26 are each arcuately shaped in longitudinal cross-section. Because of the shapes of the pieces of the food bin assembly 20, water easily flows off of the lid members 24, 26 without leaking into the bin 22. Also because of the shapes of these pieces, the front lid member 26 does not need to be raised to a substantially horizontal position before it can be slid rearwardly; to enable the front lid member 26 to be slid rearwardly, it needs only to be raised an amount sufficient to allow the rim front portion 76 to clear the upper edge margin 50 of the bin front wall 30.

In operation, the front lid member 26 is placed on the bin 22 to cover the front portion of the bin opening 40 and the rear lid member 24 is placed on the bin 22 to cover the rear portion of the bin opening. Movement of the front lid member 26 between its forward and rearward positions and between its lowered and raised positions is independent of the rear lid member 24. In other words, the front lid member 26 may be slid on the bin 22 between its forward and rearward positions regardless of whether the rear lid member 24 is present. Also, the front lid member 26 may be pivoted on the bin 22 between its raised and lowered positions regardless of whether the rear lid member 24 is present. Moreover, because of the shape and configuration of the lid members 24, 26, any contact therebetween during movement of the front lid member between its rearward and forward positions or between its raised and lowered positions is incidental.

Moreover, although the apparatus 20 is referred to as a food bin assembly, it is to be understood that such a reference is not intended to limit its application. In other words, the food bin assembly 20 may instead be used as a bin for non-food items without departing from the scope of this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. It is intended that the invention shall be limited solely by the scope of the claims.

What is claimed is:

1. A food bin assembly comprising:

a bin having a bottom, and a plurality of walls extending up from the bottom and having upper ends defining a bin opening, one of the walls being a first side wall and another of the walls being a second side wall opposite the first side wall;

a rear lid member configured for covering a rear portion of the bin opening; and a front lid member configured for covering a forward portion of the bin opening;

the front lid member being slidably connected to the first and second side walls of the bin for longitudinal sliding movement of the front lid member relative to the bin between a forward position in which the front lid member is positioned over the forward portion of the bin opening and a rearward position in which the front lid member is positioned over the rear portion of the bin opening, the front lid member further being pivotally connected to the first and second side walls of the bin for pivotal movement of the front lid member between a lowered position in which it covers the forward portion of the bin opening and a raised position in which it extends-upwardly from the side walls to provide access to the forward portion of the bin opening.

2. A food bin assembly as set forth in claim 1 wherein the bin and lid members are configured such that the front lid member is positioned under the rear lid member when the front lid member is in its rearward position.

3. A food bin assembly as set forth in claim 1 wherein at least one of the first and second side walls of the bin are configured for releasably locking the lid in its raised position.

4. A food bin assembly as set forth in claim 1 wherein the front lid portion has a generally arcuate shape in longitudinal cross-section.

5. A food bin assembly as set forth in claim 4 wherein the rear lid portion has a generally arcuate shape in longitudinal cross-section.

6. A food bin assembly as set forth in claim 1 wherein the first and second side walls have upper edge margins which are generally parallel to one another and wherein the front lid member has a rim extending generally downwardly when the front lid member is in its forward position, the rim of the front lid member having rim side portions positioned adjacent to and laterally outward of the upper edge margins of the first and second side walls when the front lid member is in its forward position.

7. A food bin assembly as set forth in claim 6 wherein the upper edge margins of the first and second side walls are configured for limiting lateral movement of the front lid member and for guiding the front lid member between its forward and rearward positions.

8. A food bin assembly as set forth in claim 6 wherein the rim side portions have rear ends slidably engageable with the upper edge margins of the first and second side walls of the bin as the front lid member is moved between its forward and rearward positions.

9. A food bin assembly as set forth in claim 6 wherein one of said plurality of walls of the bin further includes a front wall, the front wall having an upper edge margin extending laterally from the upper edge margin of the first side wall to the upper edge margin of the second side wall, and wherein the rim of the front lid member further includes a rim front portion extending generally between the rim side portions, said rim front portion being positioned adjacent to and forward of the upper edge margin of the front wall of the bin when the front lid member is in its forward position.

10. A food bin assembly as set forth in claim 9 wherein the rim front portion of the front lid member is configured for slidably engaging the upper edge margins of the side walls of the bin as the front lid member is moved between its forward and rearward positions.

11. A food bin assembly as set forth in claim 1 wherein the bin is a single unitary piece and wherein the front lid member is a single unitary piece.

12. A food bin assembly comprising:

a bin having a bottom, and a plurality of walls extending up from the bottom and having upper ends defining a bin opening, one of the walls being a first side wall and another of the walls being a second side wall opposite the first side wall;

a rear lid member configured for covering a rear portion of the bin opening; and a front lid member configured for covering a forward portion of the bin opening;

the front lid member being slidably connected to the first and second side walls of the bin for longitudinal sliding movement of the front lid member on the first and second side walls of the bin between a forward position in which the front lid member is positioned over the forward portion of the bin opening and a rearward position in which the front lid member is positioned over the rear portion of the bin opening, the front lid member further being pivotally connected to the first and second side walls of the bin for pivotal movement of the front lid member between a lowered position in which it covers the forward portion of the bin opening and a raised position in which it extends upwardly from the side walls to provide access to the forward portion of the bin opening, said sliding and pivotal movements of the forward portion being independent of the rear portion.

13. A food bin assembly as set forth in claim 12 wherein the bin and lid members are configured such that the front lid member is positioned under the rear lid member when the front lid member is in its rearward position.

14. A food bin assembly as set forth in claim 12 wherein at least one of the first and second side walls of the bin are configured for releasably locking the lid in its raised position.

15. A food bin assembly as set forth in claim 12 wherein the front lid member is inclined when in its forward position.

16. A food bin assembly as set forth in claim 12 wherein the first and second side walls have upper edge margins which are generally parallel to one another and wherein the front lid member has a rim extending generally downwardly when the front lid member is in its forward position, the rim of the front lid member having rim side portions positioned adjacent to and laterally outward of the upper edge margins of the first and second side walls when the front lid member is in its forward position.

17. A food bin assembly as set forth in claim 16 wherein the upper edge margins of the first and second side walls are configured for limiting lateral movement of the front lid member and for guiding the front lid member between its forward and rearward positions.

18. A food bin assembly as set forth in claim 16 wherein the rim side portions have rear ends slidably engageable with the upper edge margins of the first and second side walls of the bin as the front lid member is moved between its forward and rearward positions.

19. A food bin assembly as set forth in claim 16 wherein one of said plurality of walls of the bin further includes a front wall, the front wall having an upper edge margin extending laterally from the upper edge margin of the first side wall to the upper edge margin of the second side wall, and wherein the rim of the front lid member further includes a rim front portion extending generally between the rim side portions, said rim front portion being positioned adjacent to and forward of the upper edge margin of the front wall of the bin when the front lid member is in its forward position.

20. A food bin assembly as set forth in claim 19 wherein the rim front portion of the front lid member is configured for slidably engaging the upper edge margins of the side walls of the bin as the front lid member is moved between its forward and rearward positions.

21. A food bin assembly as set forth in claim 12 wherein the front lid member's forward position is the same as its lowered position.

* * * * *